US008668049B2

(12) United States Patent
Leng

(10) Patent No.: US 8,668,049 B2
(45) Date of Patent: Mar. 11, 2014

(54) LADDER

(75) Inventor: Luhao Leng, Xiamen (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 329 days.

(21) Appl. No.: 12/671,286

(22) PCT Filed: Dec. 29, 2008

(86) PCT No.: PCT/CN2008/073814

§ 371 (c)(1),
(2), (4) Date: Jan. 29, 2010

(87) PCT Pub. No.: WO2009/089759

PCT Pub. Date: Jul. 23, 2009

(65) Prior Publication Data

US 2011/0011679 A1 Jan. 20, 2011

(30) Foreign Application Priority Data

Dec. 29, 2007 (CN) ..... 2008 2 0101013 U
Nov. 6, 2008 (CN) ..... 2008 2 0176147 U

(51) Int. Cl.
*E06C 7/08* (2006.01)

(52) U.S. Cl.
CPC ..... *E06C 7/086* (2013.01)
USPC ..... 182/228.6; 182/228.3; 182/228.4

(58) Field of Classification Search
USPC ..... 182/228.1, 228.3, 228.4, 228.6
See application file for complete search history.

(56) References Cited

U.S. PATENT DOCUMENTS

| | | | | | |
|---|---|---|---|---|---|
| 872,165 | A | * | 11/1907 | Adler | 182/219 |
| 1,045,957 | A | * | 12/1912 | Dicks | 138/111 |
| 2,989,141 | A | * | 6/1961 | Howard | 182/216 |
| 3,481,428 | A | * | 12/1969 | Wedin et al. | 182/46 |
| 3,502,173 | A | * | 3/1970 | Arnold | 182/46 |
| 3,566,992 | A | * | 3/1971 | Berger | 182/228.6 |
| 3,653,697 | A | * | 4/1972 | Ernst | 403/243 |
| 3,674,293 | A | * | 7/1972 | Parsons | 403/234 |
| 3,893,776 | A | * | 7/1975 | Beattie | 403/259 |
| 3,949,836 | A | * | 4/1976 | Russo | 182/194 |
| 3,970,400 | A | * | 7/1976 | Reid | 403/242 |
| 3,997,027 | A | * | 12/1976 | Patterson et al. | 182/195 |
| 4,036,325 | A | * | 7/1977 | Ruff et al. | 182/46 |
| 4,063,836 | A | * | 12/1977 | Militano | 403/263 |
| 4,086,980 | A | * | 5/1978 | Shortes et al. | 182/151 |

(Continued)

FOREIGN PATENT DOCUMENTS

| | | | |
|---|---|---|---|
| CH | 683445 | A5 | 3/1994 |
| CN | 2275158 | Y | 2/1998 |
| CN | 1916353 | A | 2/2007 |
| JP | 2002220984 | A | 8/2002 |

*Primary Examiner* — Alvin Chin Shue
*Assistant Examiner* — Colleen M Chavchavadze
(74) *Attorney, Agent, or Firm* — Rabin & Berdo, P.C.

(57) ABSTRACT

A ladder comprises two stiles and at least a step unit mounted between the two stiles. The step unit includes a hollow step, an inner sleeve and an outer sleeve. The inner sleeve is fit into the hollow step, at an end of which a position restriction portion is located to prevent the inner sleeve from moving out, and the outer sleeve is adapted to surround the end of the hollow step. Besides, a fastener is set, the fastening end of which is passed through the stile, the outer sleeve and fastened in the inner sleeve. The present technique solution has a high supporting strength and a high shear resistance.

6 Claims, 7 Drawing Sheets

(56) References Cited

U.S. PATENT DOCUMENTS

| | | | | |
|---|---|---|---|---|
| 4,162,861 | A * | 7/1979 | Reid et al. | 403/242 |
| 4,926,967 | A * | 5/1990 | Baker et al. | 182/164 |
| 6,155,741 | A | 12/2000 | Took | |
| 6,708,800 | B2 * | 3/2004 | Kieffer et al. | 182/195 |
| 6,883,645 | B2 * | 4/2005 | Kieffer et al. | 182/195 |
| 7,048,094 | B2 * | 5/2006 | Kieffer et al. | 182/195 |
| 7,108,103 | B2 * | 9/2006 | Meeker | 182/165 |
| 2006/0283664 | A1 * | 12/2006 | Yao | 182/156 |
| 2007/0209875 | A1 * | 9/2007 | Chen | 182/195 |

* cited by examiner

LADDER

FIELD OF THE INVENTION

The present invention relates to a ladder.

BACKGROUND OF THE INVENTION

The existing ladder comprises two stiles and at least a step mounted between the two stiles. The existing ladder generally comprises two structures below:

The first mounting structure, which utilizes a fastener directly fastens the stile and step, said supporting structure has drawbacks as follows: the shearing force generated between the step and stile is only supported by the fastener, so the fastener is easy to breakdown, its life length is relatively short and its safety performance is relatively low.

The second mounting structure, its stile is disposed with through hole, the end of step is embedded into the through hole and then be fastened, although said supporting structure is able to solve the drawbacks of the above mounting supporting structure, it has its own shortages: because the stile has to set through hole on it, so the strength of the stile would be eliminated. In order to enhance the strength of the stile, it has to enlarge the cross section of the stile or use a solid stile, which will greatly increase the quantity of material used and the manufacturing cost.

SUMMARY OF THE INVENTION

The present invention provides a ladder, it overcomes the shortages of the background techniques which have a low safety performance and a high manufacturing cost.

The technical solution applied in the present invention is:

A ladder, comprising two stiles and at least a step unit mounted between the two stiles, said step unit comprising a hollow step, an inner sleeve and an outer sleeve, said inner sleeve is fit into the hollow step, at an end of which a position restriction portion is located to prevent the inner sleeve from moving out, and the outer sleeve is adapted to surround the end of the hollow step; besides, a fastener is set, the fastening end of which is passed through the stile, the outer sleeve and fastened in the inner sleeve.

In a preferred embodiment of the present invention, said position restriction portion is an enclosure opening located on the end of hollow step, its inner circumferential edge is smaller than the outer circumferential edge of inner sleeve.

In a preferred embodiment of the present invention, said fastener is a self-tapping screw.

In a preferred embodiment of the present invention, the inner side surface of said stile is disposed with a longitudinal connection slot, said outer sleeve is clipped tightly in the connection slot.

In a preferred embodiment of the present invention, said outer sleeve surrounds the enclosure opening of hollow step.

In a preferred embodiment of the present invention, the outside of said outer sleeve is projecting disposed with a clamping jaw, which can restrict the rotation of said outer sleeve and be able to clamp in the connection slot.

In a preferred embodiment of the present invention, said inner sleeve is disposed with a fastener seat, the fastening end of which is passed through the stile, the outer sleeve and fastened in the inner sleeve.

In a preferred embodiment of the present invention, the inside of said inner sleeve is projecting disposed with fixed plates, there is a fastener seat mounted between the end of said fixed plates; the fastening end of which is passed through the stile, the outer sleeve and fastened in the inner sleeve.

In a preferred embodiment of the present invention, the outer side surface of said stile is disposed with a locating slot; further disposing a plastic element interference fit inside the locating slot; the fastening end of which is passed through the plastic element, the stile, the outer sleeve and fastened in the inner sleeve.

Compared to the background techniques: firstly, the shearing force generated between the step and stile is not only supported by the fastener, but also supported by the friction force or clamping force between the outer sleeve and connection slot, so the supporting force and the shear resistance are relatively high; secondly, because the position restriction portion can prevent the inner sleeve from moving out, so the fastening of inner sleeve and stile can also fasten the step, the outer sleeve and stile simultaneously, it is convenient to connect and its connection strength is high, the strength of each part would not be eliminated because of the connection; thirdly, inferred from the secondly advantage, the connection slot disposed on the stile is able to connect the step unit firmly, and would not eliminate the supporting strength of stile, thereby the quantity of material used would not be increased; fourthly, because the end of step is designed as an enclosure opening, which forms the position restriction portion, so the enclosure opening would not only be able to firmly locate the inner sleeve, but also the manufacture process is convenient and timesaving, further the strength of the step would not be eliminated; fifthly, because the outer sleeve surrounds the enclosure opening of step, so it not only can support the step and bear the shearing force, but also can prevent the enclosure opening from expanding by tightly surrounding it, prevents the inner sleeve from pulling out because of the pulling of the fastener; sixthly, because a clamping jaw is projecting disposed outside of the outer sleeve, it can not only restrict the rotation of outer sleeve, but also can clamp in the connection slot, so a great amount of friction force or clamping force would be generated; seventhly, it further disposed with a plastic element which is interference fit inside the locating slot, so the strength of the friction force between the plastic element and the locating slot is great enough to bear the shearing force; eighthly, the fastener seat is disposed by the end of fixed plate, that is also the center of inner sleeve, so the connection is firm.

BRIEF DESCRIPTION OF THE DRAWINGS

The present invention will become apparent upon the reference of the accompanying drawings and the description of the preferred embodiment.

DETAILED DESCRIPTION OF THE EMBODIMENTS

Figure 1:
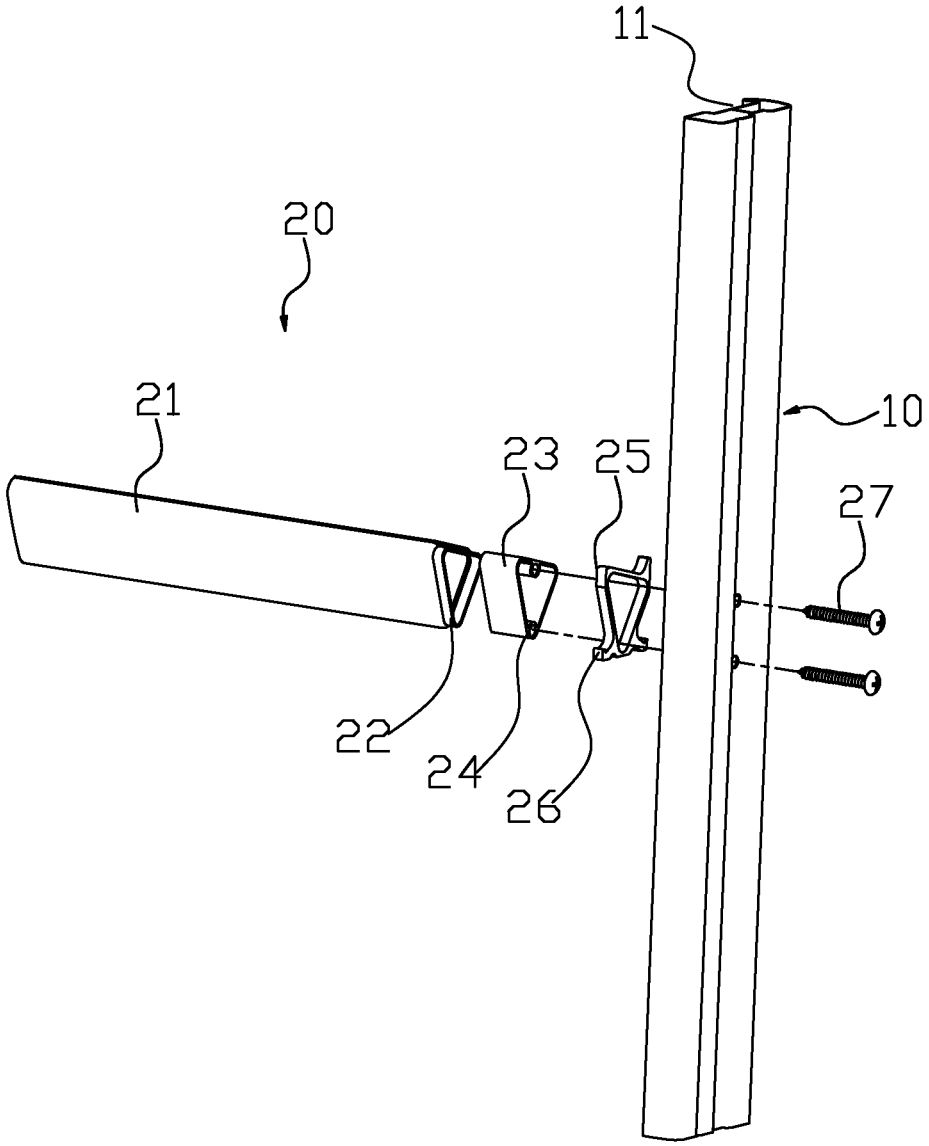
FIG. 1 illustrates the perspective exploded view of the cooperation of the stile and step unit of a preferred embodiment.
Figure 2:
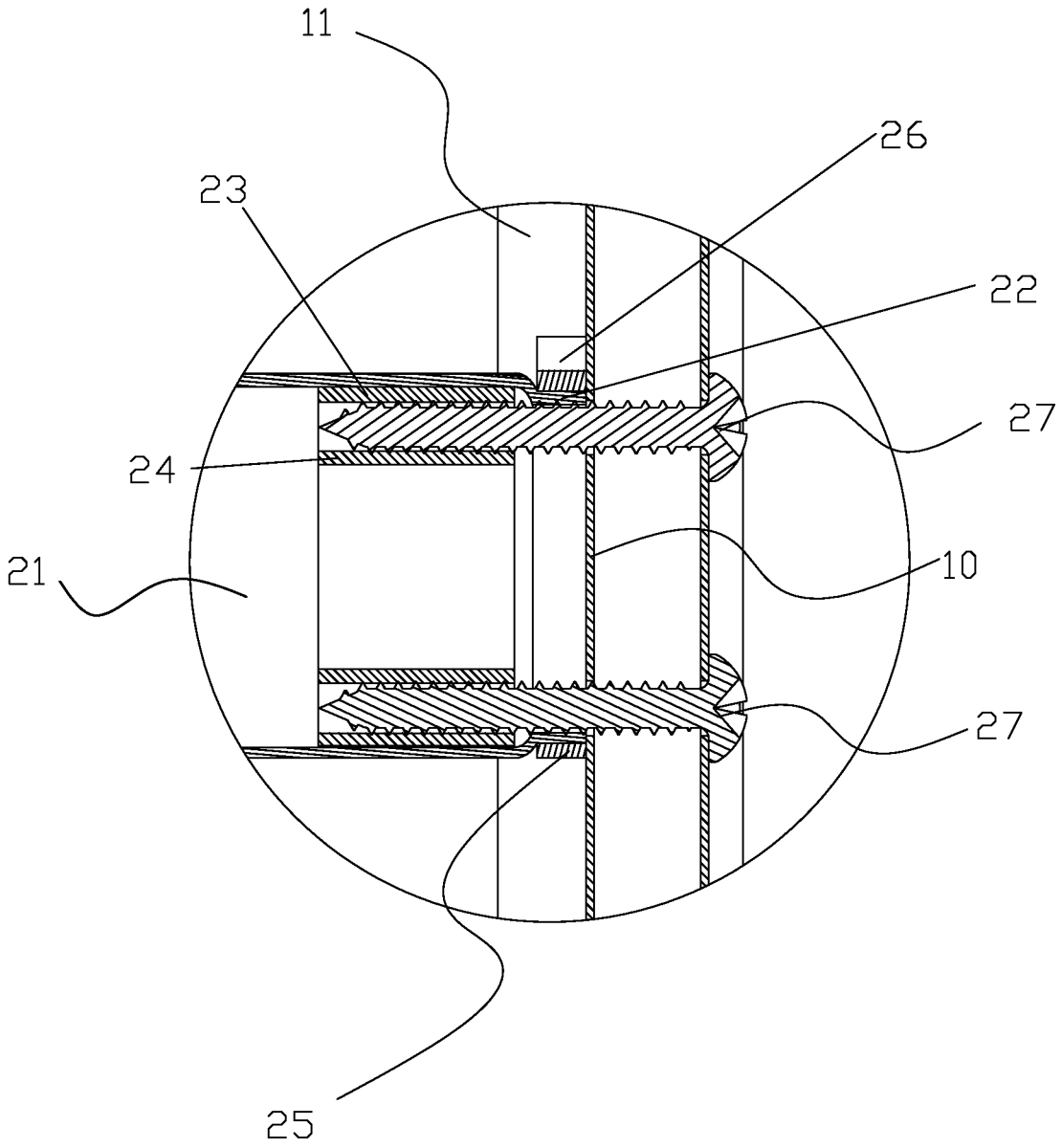
FIG. 2 illustrates the sectional view of the cooperation of stile and step unit of a preferred embodiment.

Please refer to FIG. 1 and FIG. 2, a ladder comprising two stiles 10 and a plurality of step units 20, said step units 20 are mounted between the two stiles 10.

Said stile is hollow, the cooperation surface (inner side surface) of the stile is longitudinally disposed with an inward concave connection slot 11, the inward concave design of said connection slot 11 can enhance the strength of stile 10.

Said step unit comprises a triangle hollow step 21, an inner sleeve 23 and an outer sleeve 25. Said inner sleeve 23 is fit into the hollow step 21; the end of said hollow step 21 is made as an constricting opening 22, the inner circumferential edge of said constricting opening 22 is smaller than the outer circumferential edge of inner sleeve 23, thereby said constricting opening 22 can prevent the inner sleeve 23 from moving out of hollow step 21. Said outer sleeve 25 has a inner hole and a plurality of projecting and outwardly clamping jaws 26, said inner hole is fit to the enclosure opening of hollow step 21, and surrounds the constricting opening 22 of hollow step 21; the inside of said inner sleeve 23 is disposed with two fastener seats 24, an inner thread aperture is disposed on said fastener seat.

The present embodiment applies the constricting opening 22 for position restriction, but it is not limited within the scope, other structures like a projecting block which is projecting disposed inside the hollow step or a position restriction pin passes through hollow step are also able for position restriction, and adaptable for the present embodiment.

Figure 3:
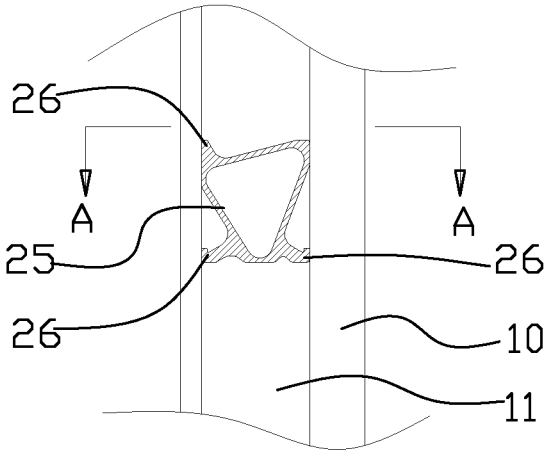
FIG. 3 illustrates the sectional view of the cooperation of stile and outer sleeve of a preferred embodiment.
Figure 4:
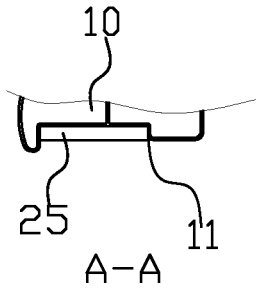
FIG. 4 illustrates the sectional view of A-A line of FIG. 3.

In the assembling process: said outer sleeve 25 is clamped inside the connection slot 11, the clamping jaw 26 of said outer sleeve 25 clamped on the two side surfaces of the connection slot 11 to generate a strong friction force or a strong clamping force, as showed in FIG. 3 and FIG. 4. The clamping jaw 26 can restrict the outer sleeve 25 to rotate relative to stile 10 and strengthen the friction force between the outer sleeve 25 and connection slot 11.

Besides, two self-tapping screws 27 are set, their fastening ends are passed through the stile 10, the outer sleeve 25 and respectively fastened on the inner thread apertures of the two fastener seats 24 of inner sleeve 23. Because the self-tapping screw 27 is fastened on the stile 10 and inner sleeve 23, the constricting opening 22 would restrict the inner sleeve 23 from moving out, thereby the step 21, the outer sleeve 25 and the stile 10 can be fastened simultaneously and be limited to move transversely, finally the step unit and stile can be mounted together.

Figure 5:
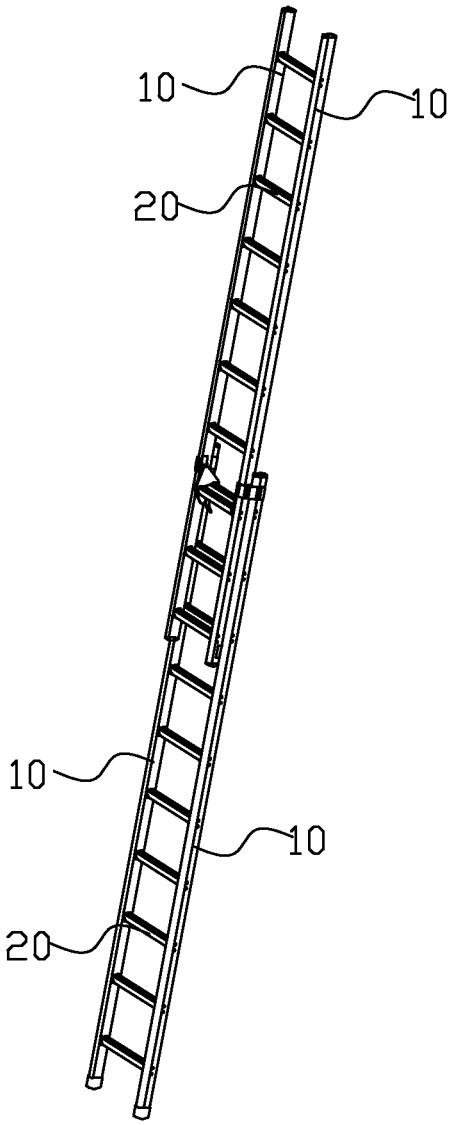
FIG. 5 illustrates the perspective view of an extension ladder of a preferred embodiment.

Please refer to FIG. 5, it illustrates an extension ladder, the mounting supporting structure of the stile 10 and the step unit 20 of said extension ladder applies above mounting supporting structure. Although the present embodiment only take the extension ladder as the preferred embodiment, it is not limited within the scope, other ladders like trestle ladder, or single ladder are also applicable in the present embodiment.

Figure 6:
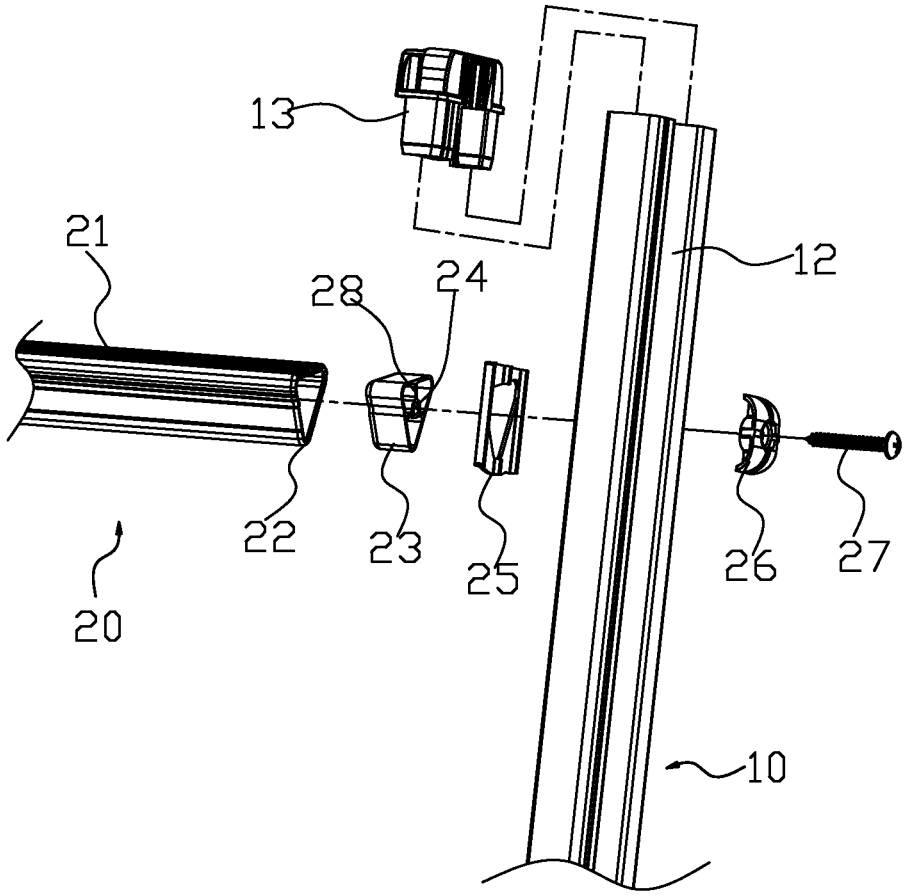
FIG. 6 illustrates the perspective exploded view of cooperation of the stile and step unit of another preferred embodiment.

In another preferred embodiment, please refer to FIG. 6, a ladder, it comprises two stiles 10 and a plurality of step units 20, said step units 20 are mounted supporting between the two stiles 10.

The inner side surface of said stile 10 is longitudinally disposed with a connection slot 11, the outer side surface is disposed with a inwardly concave locating slot 12, besides, a blocking head 13 is blocked on the top end of stile 10.

Figure 7:
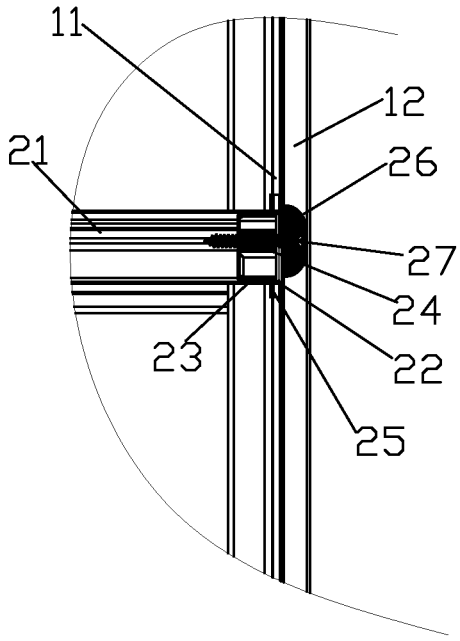
FIG. 7 illustrates the longitudinal sectional view of cooperation of the stile and step unit of another preferred embodiment.
Figure 8:
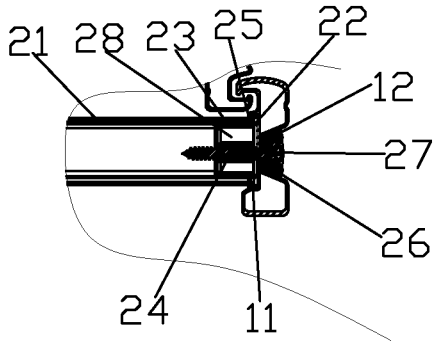
FIG. 8 illustrates the transverse sectional view of cooperation of the stile and step unit of another preferred embodiment.
Figure 9:
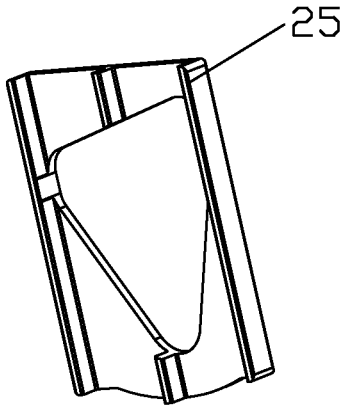
FIG. 9 illustrates the perspective view of the outer sleeve of another preferred embodiment.
Figure 10:
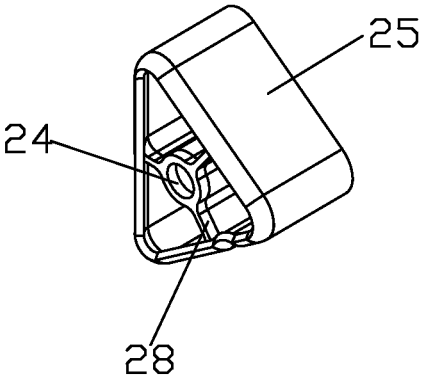
FIG. 10 illustrates the perspective view of the inner sleeve of another preferred embodiment.

Please refer to FIG. 6, FIG. 7 and FIG. 8, said step unit 20 comprising a triangle hollow step 21, an inner sleeve 23 and outer sleeve 25. Said inner sleeve 23 is fit into the hollow step 21; the end of said hollow step 21 is made as an constricting opening 22, the inner circumferential edge of said constricting opening 22 is smaller than the outer circumferential edge of inner sleeve 23; thus said constricting opening 22 can prevent the inner sleeve 23 from moving out of hollow step 21. Please refer to FIG. 10, there are three fixed plates 28 projecting disposed inside said inner sleeve 23, there is a fastener seat 24 mounted between the ends of said fixed plates 28, said fastened seat 24 has an inner thread aperture. Please refer to FIG. 9, said outer sleeve 25 is non-circular, and has an inner hole, said inner hole is fit to the end of hollow step 21 and surrounds the end of hollow step 21.

In the assembling process: said outer sleeve 25 interference fit in the connection slot 11 and generates a great amount of friction force or clamping force, as showed in FIG. 7 and FIG. 8. Because said outer sleeve 25 is interference fit inside the connection slot 11, so the outer sleeve 25 can rotate relative to stile 10, and the friction force between the outer sleeve 25 and connection slot 11 can be enhanced.

Besides a plastic element 26 and a self-tapping screw 27 are set, said plastic element 26 is disposed inside the locating slot 12 (the plastic element will expand after disposing so as to interference fit inside the locating slot 12), the fastening end of said self-tapping screw 27 is passed through the plastic element 26, the stile 10 and outer sleeve 25 and fastened in the inner thread aperture of the fastener seat 24 of inner sleeve 23.

Because the self-tapping screw 27 fastened the stile 10 and inner sleeve 23, the constricting opening 22 restricts the inner sleeve 23 from moving out, so the step 21, the plastic plate 26, the outer sleeve 25 and stile 10 will be fastened simultaneously, and be limited to move transversely, finally the step unit and stile can be mounted together.

Although the present invention has been described with reference to the preferred embodiments thereof for carrying out the invention, it is apparent to those skilled in the art that a variety of modifications and changes may be made without departing from the scope of the present invention which is intended to be defined by the appended claims.

INDUSTRIAL APPLICABILITY

The ladder of the present invention, its step unit is mounted between the two stiles, said step unit comprising hollow steps, inner sleeve and outer sleeve, said inner sleeve is fit into the hollow steps, at an end of which a position restriction portion is located to prevent the inner sleeve from moving out, and the outer sleeve is adapted to surround the end of the hollow step. The present technique solution has a high supporting strength and shear resistance, which has a good industrial applicability.

What is claimed is:

1. A ladder comprising:

two stiles, each of the stiles having a longitudinal connection groove on an inner side thereof;

a step unit mounted between the two stiles, said step unit comprising:

a hollow step having an end with a constricting opening, the hollow step having an inner cross-section profile defined by an inner tubular surface and an outer cross-section profile;

a continuous inner sleeve located entirely inside the hollow step, the constricting opening preventing the inner sleeve from moving out of the hollow step, the inner sleeve having an inner thread aperture and an outside cross-section profile substantially corresponding to the inner cross-section profile of the hollow step; and an outer sleeve having an opening having a second inner cross-section profile, the second inner cross-section profile substantially corresponding to the outer cross-section profile of the hollow step, the opening receiving and surrounding the end of the hollow step, the outer sleeve engaging a respective longitudinal connection groove; and a fastener passing through one of the stiles, and the outer sleeve and being fastened to the inner thread aperture in the inner sleeve, wherein a circumference of the constricting is smaller than a circumference of the inner tubular surface.

2. The ladder according to claim 1, wherein the circumference of the constricting opening is smaller than an outer circumference of the inner sleeve.

3. The ladder according to claim 2, wherein said fastener is a self-tapping screw.

4. The ladder according to claim 1, wherein the outer sleeve comprises a clamping jaw that clamps the connection groove and prevents a rotation of said outer sleeve.

5. The ladder according to claim 1, wherein said inner sleeve comprises a plurality of fixed plates projecting from an inside thereof, and a fastener seat at ends of the plurality of fixed plates, and wherein said inner thread aperture is located in the fastener seat.

6. The ladder according to claim 1, wherein each of the stiles has a longitudinal locating groove on an outer side of the thereof, further comprising a plastic element located in a respective locating groove; and wherein the fastener passes through the plastic element before passing through the one of the stiles.

* * * * *